US006094869A

United States Patent [19]

Magoon et al.

[11] Patent Number: 6,094,869

[45] **Date of Patent: *Aug. 1, 2000**

[54] SELF-RETAINING CONFIGURABLE FACE PLATE

[75] Inventors: Robert Dean Magoon, Duluth; Gregory B. McKenna, Cumming, both of Ga.

[73] Assignee: Kawneer Company, Inc., Alcoa Center, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,941

[22] Filed: Dec. 23, 1996

[51] Int. Cl.[7] ..... E05F 11/00

[52] U.S. Cl. ..... 49/460; 70/450

[58] Field of Search ..... 49/460, 503, 394; 70/450, 461, 466, 417, 416, 418; 292/346

[56] References Cited

U.S. PATENT DOCUMENTS

| | | | |
|---|---|---|---|
| 611,979 | 10/1898 | Shaw | 70/450 |
| 891,449 | 6/1908 | Sparks | 70/450 |
| 2,497,189 | 2/1950 | Shaffer | 70/450 |
| 2,799,063 | 7/1957 | Miller | 70/450 X |
| 3,651,673 | 3/1972 | Sendrowski et al. | 70/450 |
| 4,080,813 | 3/1978 | McKann | 70/450 |
| 4,213,317 | 7/1980 | Ruff | 70/450 |
| 4,635,399 | 1/1987 | Gehrke et al. | 292/346 X |
| 5,076,461 | 12/1991 | Nichols | 292/DIG. 38 X |

*Primary Examiner*—Jerry Redman
*Attorney, Agent, or Firm*—Jones & Askew, LLP

[57] ABSTRACT

A face plate is disclosed for concealing the exposed edge of a lock mechanism when installed within the lock stile of a door. To accommodate the plunger and deadbolt of the lock mechanism, the face plate comprises a plurality of separation lines defining removable portions or "knockouts" corresponding to various lock configurations. Depending upon the configuration of the lock mechanism being used, a corresponding one or combination of the removable portions can be removed to accommodate the particular lock mechanism. In addition, the face plate comprises tabs at the upper and lower edges which hook beneath the vertical edge wall of the door stile adjacent the upper and lower ends of the opening within which the lock mechanism is installed. The tabs hold the upper and lower edges of the lock plate with the opening and can either reduce the number of screws required to secure the face plate to the door or can eliminate the need for screws altogether.

7 Claims, 7 Drawing Sheets

SELF-RETAINING CONFIGURABLE FACE PLATE

TECHNICAL FIELD

The present invention relates generally to face plates for doors. More specifically, the invention relates to a face plate which retains itself in place within a mortise in a door stile and which has a plurality of knock-outs, appropriate ones of which can be removed or left in place to accommodate various lock configurations.

BACKGROUND OF THE INVENTION

To facilitate the mounting of lock hardware, a conventional metal commercial door has a rectangular opening or "mortise" on the lateral vertical edge of the lock stile. Because the lock hardware is inserted into the door through this rectangular opening, the opening must have dimensions approximately as large as the width and height of the door lock hardware. Once the door lock hardware is installed, the entire edge of the hardware is exposed through the rectangular opening in the edge of the door.

To conceal the lock hardware, a face plate is installed within the opening over the exposed edge of the lock hardware. The face plate is configured to fit closely within the opening in the door and fastens to the edge of the lock within the mortise while the threaded fasteners are being installed. Typically three screws are required to secure the top, bottom, and middle of the face plate. Providing screws creates additional handling and inventory demands. In addition, screws can become lost or separated from the faceplate.

Thus there is a need for a face plate which can be held in place on the vertical edge of the lock stile with fewer fasteners, or with no fasteners at all.

The plunger and/or deadbolt engages the door frame through corresponding apertures in the face plate. Because various types of lock hardware, such as long throw deadbolts, short throw deadbolts, hook bolts, and latch locks all have different configurations of plungers and/or deadbolts, each configuration of lock hardware requires a corresponding configuration of face plate.

Thus it would be desirable to provide a face plate which would accommodate a variety of plunger/deadbolt configurations.

SUMMARY OF THE INVENTION

The present invention overcomes these and other problems associated with prior art door lock face plates. Stated generally, the present invention comprises a lock plate which is easily configurable to a variety of plunger/dead bolt configurations. It snaps into place within the mortise in the vertical edge of the door stile and is held there either temporarily—while a screw is installed—or permanently, requiring no screws to hold it in place. Even if a screw is used, only a single screw in the middle of the face plate is required.

Stated somewhat more specifically, the present invention comprises a face plate which includes tabs at its upper and lower edges. When the face plate is mounted within a mortise in a door stile to conceal an edge of a lock mechanism, the back face of the face plate confronts a portion of the housing of the lock mechanism to prevent the face plate from moving inward. The tabs hook behind the vertical edge of the door stile adjacent the upper and lower edges of the mortise to prevent the face plate from moving outward. The face plate is thus captured within the mortise. Thereafter either the tabs can be relied upon as the only means for holding the face plate in position, or a single fastener in the middle of the face plate can be used, relying on the tabs to hold the upper and lower edges of the face plate in place. The face plate further comprises a plurality of separation lines defining removable portions or "knockouts" corresponding to various lock configurations. Depending upon the configuration of the lock mechanism being used, a corresponding one or combination of the removable portions can be removed to accommodate the particular lock mechanism.

Thus it is an object of the present invention to provide an improved face plate for door locks.

It is another object of the present invention to provide a face plate which can be held in position without fasteners or with fewer fasteners than are conventionally used.

It is a further object of the present invention to provide an improved face plate which can accommodate a variety of configurations of lock mechanisms.

Other objects, features, and advantages of the present invention will become apparent upon reading the following specification, when taken in conjunction with the drawings and the appended claims.

DETAILED DESCRIPTION OF THE DISCLOSED EMBODIMENT

Figures 1, 2, 3, 4, 5, 6, 7:
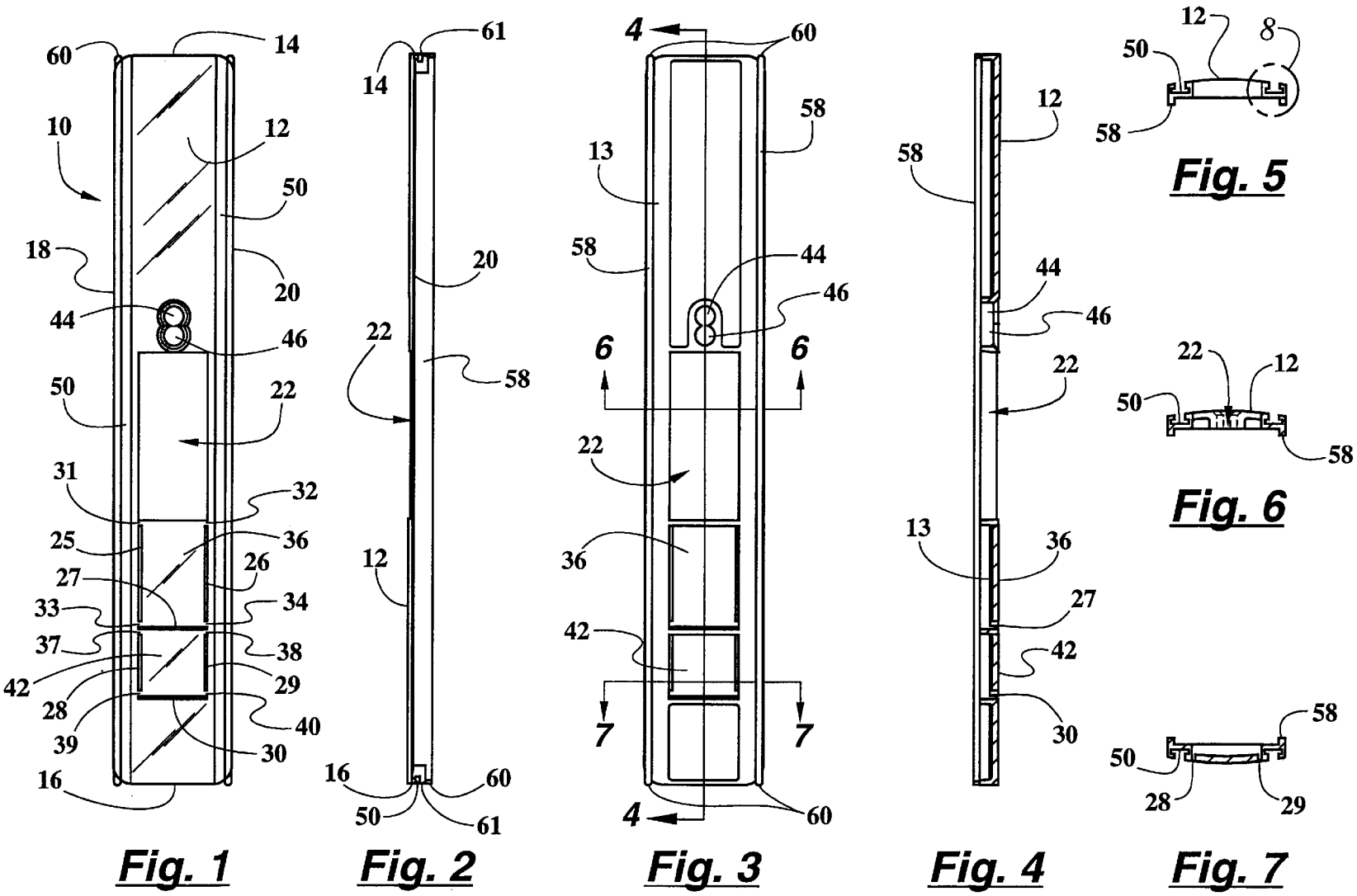
FIG. 1 is a front view of a configurable face plate according to the present invention.
FIG. 2 is a side view of the face plate of FIG. 1.
FIG. 3 is a back view of the face plate of FIG. 1.
FIG. 4 is a cut-away view along line 4—4 of FIG. 3.
FIG. 5 is a top view of the face plate of FIG. 1
FIG. 6 is a cut-away view along line 6—6 of FIG. 3.
FIG. 7 is a cut-away view along line 7—7 of FIG. 3.

Referring now to the drawings, in which like numerals indicate like elements throughout the several views, FIGS. 1–8 illustrate a face plate 10 according to the present invention. The face plate 10 has a front face 12, a back face 13, a top edge 14, a bottom edge 16, and left and right vertical edges 18, 20. A rectangular aperture 22 is formed in a central portion of the face plate 10.

The face plate 10 has a plurality of separation lines 25–30 formed therein. The separation lines 25–30 of the face plate 10 comprise narrow, elongated "core out" slots formed through the face plate. The separation lines 25–30 include a first pair of vertical separation lines 25, 26 in vertical alignment with the vertical edges of the rectangular aperture 22 and extending downward therefrom. The upper edges of the first pair of vertical separation lines 25, 26 are spaced slightly downward from the lower edge of the rectangular aperture 22 such that projection legs 31, 32 are formed between the rectangular aperture 22 and the separation lines 25, 26. A first horizontal separation line 27 is in substantial alignment with the lower edges of the separation lines 25, 26. The lateral edges of the horizontal separation line 27 are spaced apart from the lower edges of the separation lines 25, 26 to form projection legs 33, 34 between the horizontal separation line 27 and the lower edges of the separation lines 25, 26. The separation lines 25–27 define a first knockout panel 36.

The face plate 10 further includes a second pair of vertical separation lines 28, 29 formed in vertical alignment with the first pair of vertical separation lines 25, 26. The upper edges of the second pair of vertical separation lines 28, 29 are spaced slightly downward from the lower edges of the first pair of vertical separation lines 25, 26 such that projection legs 37, 38 are formed between the separation lines 25, 26 and the separation lines 28, 29. A second horizontal separation line 30 is in substantial alignment with the lower edges of the separation lines 28, 29, the lateral edges of the horizontal separation line 30 being spaced apart from the lower edges of the separation lines 28, 29 to form projection legs 39, 40 between the horizontal separation line 30 and the lower edges of the separation lines 28, 29. The separation lines 28–30 define a second knockout panel 42.

In the central portion of the face plate 10 a pair of countersunk bores 44, 46 are formed. For convenience of description, and with reference to the center of the face plate 10, the countersunk bore 44 will be referred to as the "outer" countersunk bore, and the countersunk bore 46 will be referred to as the "inner" countersunk bore. The outer and inner countersunk bores 44, 46 overlap somewhat, such that the bores generally form the shape of the numeral "8."

Figure 8:
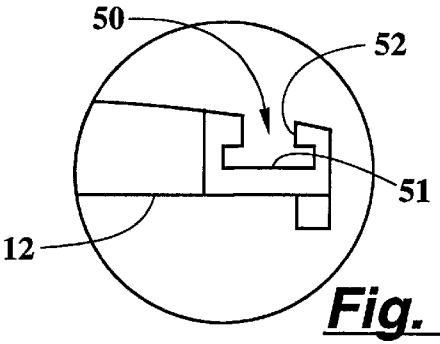
FIG. 8 is an enlarged partial top view of the area of FIG. 5 indicated by the circle 8.

Weathering channels 50 are formed along each of the vertical edges 18, 20 of the face plate 10. As can be seen in FIG. 8, each of the weathering channels 50 is shaped like an inverted "T" and has a base 51 and a neck 52 which is narrower than the base 51.

Figure 9:
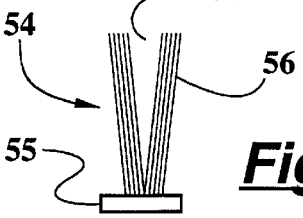
FIG. 9 is a side view of a weathering strip for use with the face plate of FIG. 1.
Figure 10:
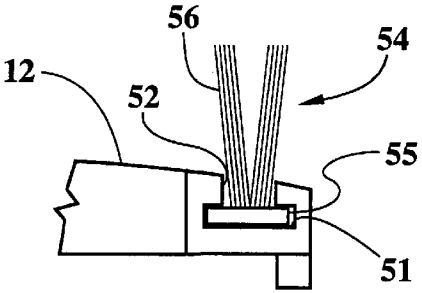
FIG. 10 is an enlarged partial top view of the area of FIG. 5 indicated by the circle 8 showing the weathering strip of FIG. 9 installed.

FIG. 9 depicts a weathering 54 which includes a body portion 55 with nylon pile 56 extending from the body portion 55. The width of the body portion 55 of the weathering 54 is less than the width of the base 51 of the weathering channel 50 but greater than the width of the neck 52 of the weathering channel 50 such that when the weathering 54 is installed within the weathering channel 50 as shown in FIG. 10, the weathering cannot become disengaged from the face plate 10 in a direction perpendicular to the face plate 10.

Referring further to FIGS. 1–8, rearwardly extending flanges 58 are formed along the vertical edges 18, 20 of the face plate 10 and project rearward from the back of the face plate 10. A protrusion extends from each end of each of the flanges 58 beyond the upper and lower corners of the front panel 12 to form tabs 60 at the upper and lower edges of the face plate 10. The forward edge 61 (FIG. 2) of each tab 60 is offset behind the front face 12 of the face plate 10. The function and purpose of the flanges 58 and tabs 60 will be explained below.

Figure 11:
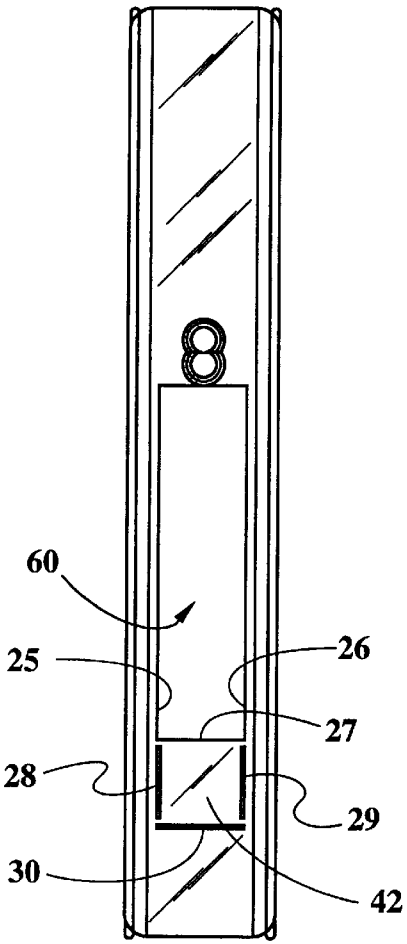
FIG. 11 is a front view of the face plate of FIG. 1 showing one knockout removed.

FIG. 11 shows a face plate 10 with the first knockout panel 36 removed. The first knockout panel 36 is removed by fracturing or cutting projection legs 31–34 to provide an opening 60 defined along its lateral edges by the separation lines 25, 26 and along its lower edge by the separation line 27.

Figure 12:
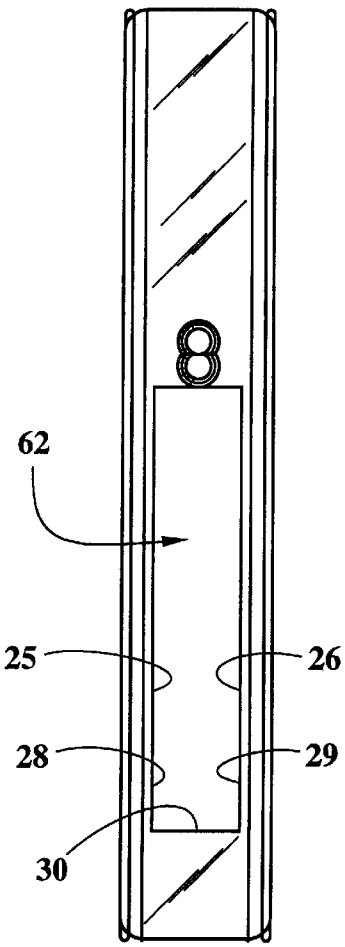
FIG. 12 is a front view of the face plate of FIG. 1 showing two knockouts removed.

FIG. 12 shows a face plate 10 with both knockout panels 36, 42 removed. The knockout panels are removed by fracturing or cutting projection legs 31–34 and 37–40 to provide an opening 62 defined along its lateral edges by the separation lines 25, 26, 28, and 29, and defined along its lower edge by the separation line 30.

Figure 13:
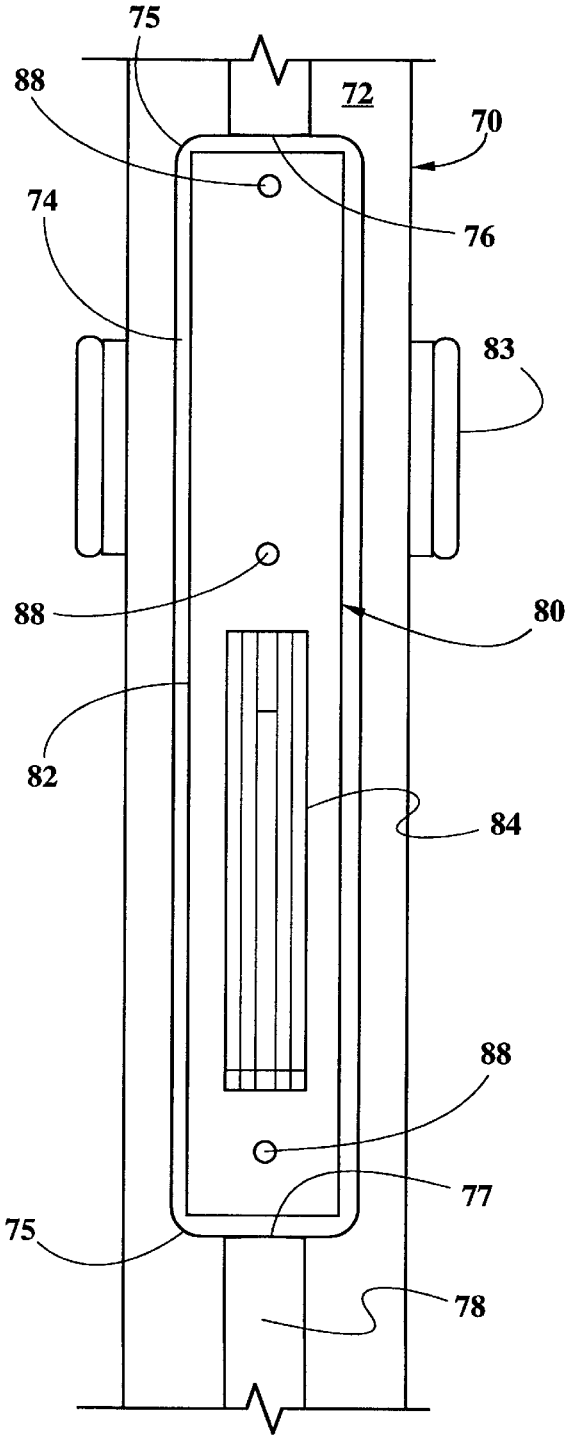
FIG. 13 is an edge view of a door stile having a mortise formed therein and having a lock mechanism installed within the mortise.

FIG. 13 shows a door stile 70 having a vertical edge 72. A mortise or cut-out 74 is formed in the vertical edge 72 of the door stile 70. The mortise 74 is generally rectangular in shape and has rounded corners 75. The mortise 74 has an upper edge 76 and a lower edge 77. A weathering channel 78 for receiving a weather strip. (not shown) runs vertically along the edge 72 of the door stile 70.

Shown mounted within the mortise 74 in the vertical edge 72 of the door stile 70 is a lock mechanism 80. The lock mechanism includes a housing 82. A pair of lock cylinders 83 are also shown in the drawings, though it will be appreciated that one of the cylinders 83 can be replaced by a thumb latch or the like, depending upon the particular application. The lock mechanism 80 further includes a dead bolt 84. Threaded holes 88 are provided in the housing 82 to receive screws for fastening a cover plate.

Figure 14:
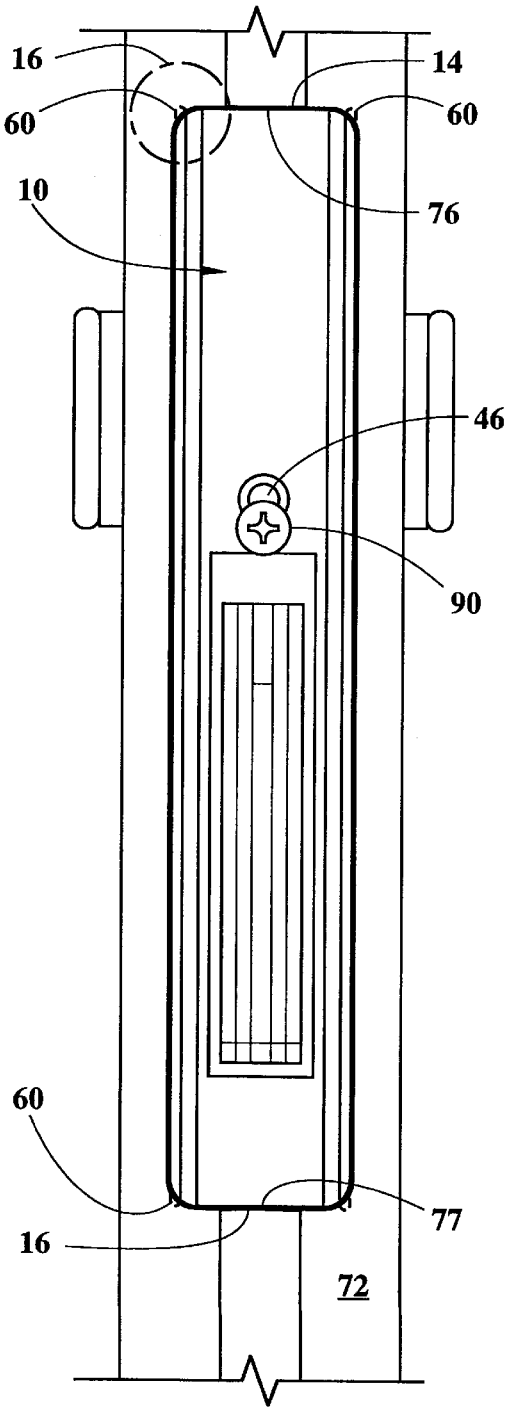
FIG. 14 is an edge view of the door stile of FIG. 13 showing the face plate of FIG. 1 installed within the mortise to conceal the exposed edge of the lock mechanism.
Figure 15:
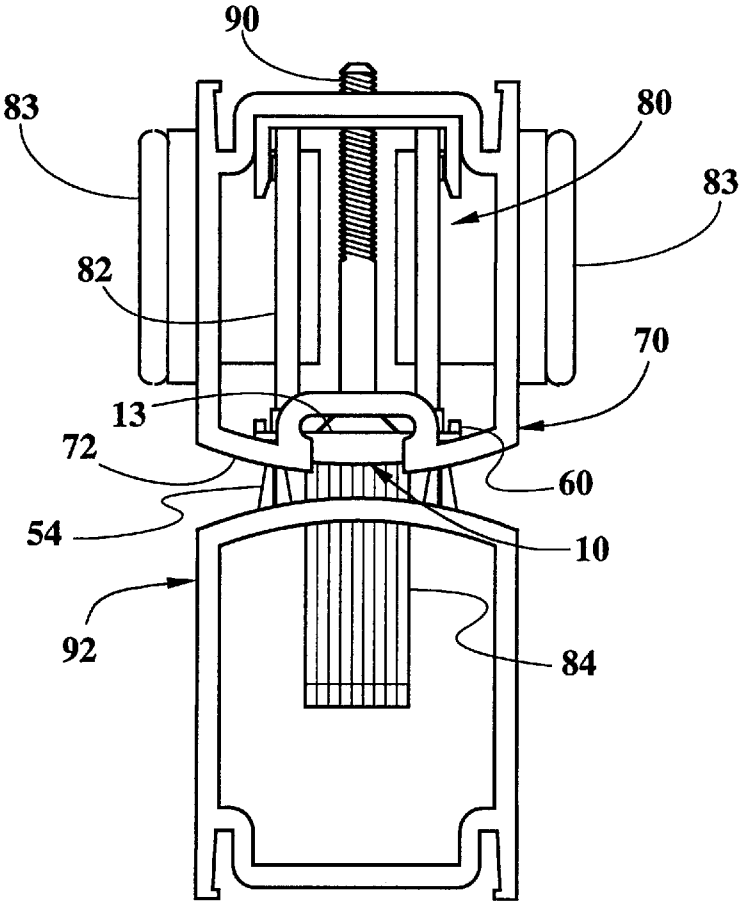
FIG. 15 is a top view of the door stile, face plate, and lock mechanism of FIG. 14.

FIGS. 14 and 15 show the vertical edge 72 of the door stile 70 with a face plate 10 mounted within the mortise 74 to conceal the lock mechanism. The face plate 10 has both knockout panels 36, 42 removed to accommodate the dead bolt 84 of the lock mechanism. The back face 13 of the face plate 10 bears against the housing 82 of the lock mechanism 80. The top and bottom edges 14, 16 of the face plate 10 are held in place by means of the tabs 60 fitting behind the vertical edge 72 of the door stile 70 adjacent the upper and lower edges 76, 77 of the mortise 74. The central portion of the face plate 10 is held in place by a screw 90 inserted through the outer countersunk bore 44 in the face plate and threaded into the center threaded hole 88 (FIG. 14) in the housing 82 of the lock mechanism 80.

With reference specifically to FIG. 15, the dead bolt 84 of the lock mechanism 80 can be extended to engage a door jamb 92. Weathering 54 mounted to the face plate 10 contacts the door jamb 92.

Figure 16:
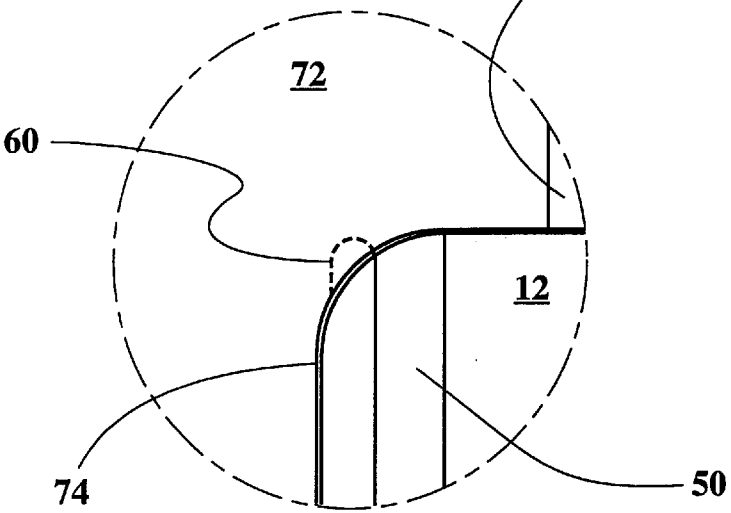
FIG. 16 is an enlarged partial view of the portion of FIG. 14 indicated by the circle 16.

FIG. 16 is an enlarged view showing a tab 60 extending beyond the mortise 72 to hook behind the vertical edge 72 of the door stile 70.

Figures 17A, 17B, 17C:
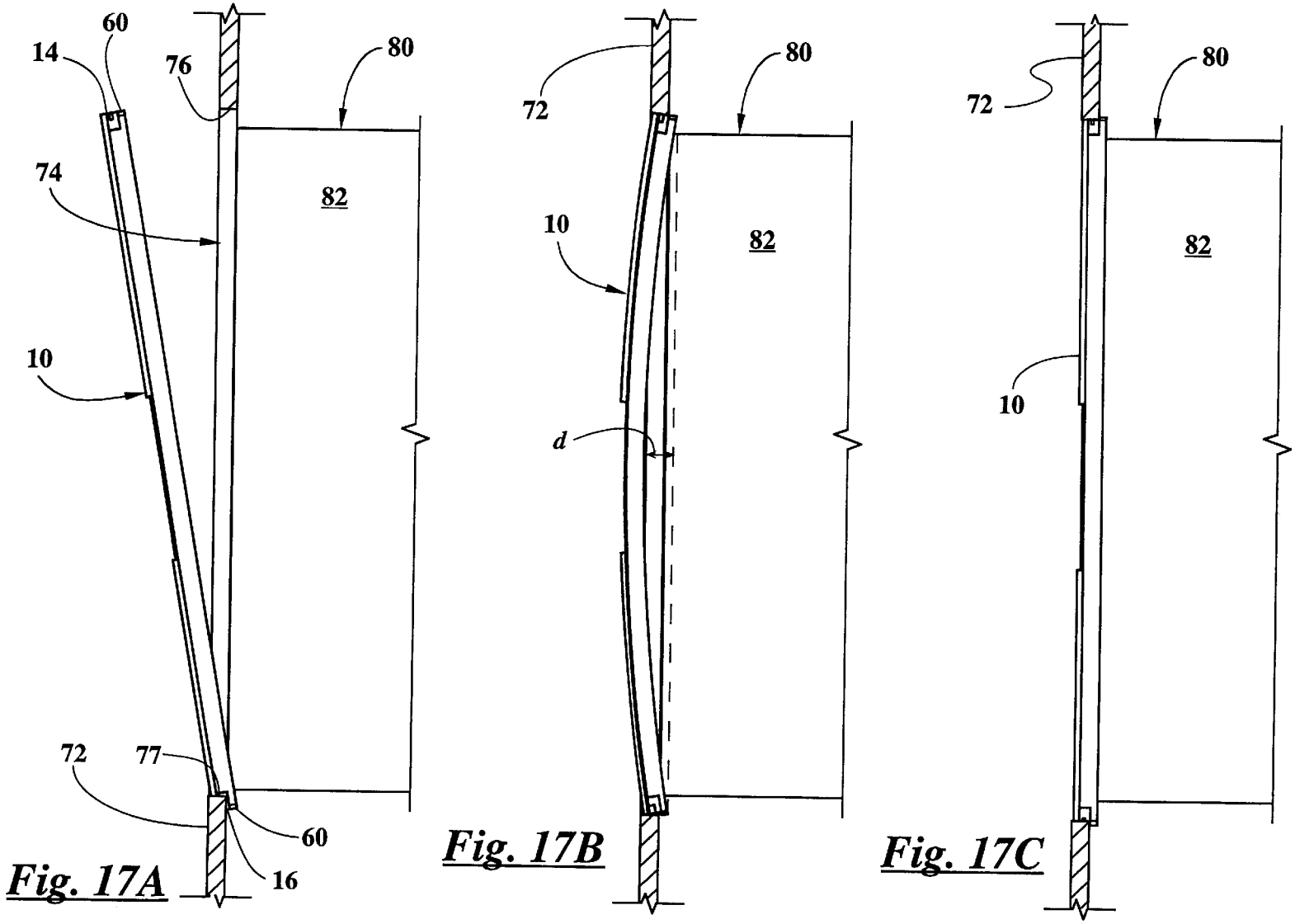
FIGS. 17A–C are side cutaway views of the door stile of FIG. 13 showing the installation of the face plate of FIG. 1 within the mortise of the door stile.

FIGS. 17A–C illustrate the procedure for installing a cover plate 10 within the mortise 74 in the vertical edge 72 of the door stile 70. Referring first to FIG. 17A, the bottom edge 16 of the face plate 10 is positioned against the lower edge 77 of the mortise 74 with the tabs 60 at the bottom edge of the face plate fitting behind the vertical edge 72 of the door stile 70. Then, as shown in FIG. 17B, the face plate 10 is bowed by a distance d so that the tabs 60 at the top edge 14 of the face plate clear the upper edge 76 of the mortise 74. As shown in FIG. 17C, the tabs 60 at the top edge 14 of the face plate 10 then hook behind the vertical edge 72 of the door stile 70 just above the upper edge 76 of the mortise 74. In this position, the face plate 10 is prevented from moving outward by the tabs 60 hooked behind the vertical edge 72 of the door stile 70, and the face plate 10 is prevented from moving inward by the housing 82 of the lock mechanism 80. Thus, the face plate 10 is held in place even without the benefit of a screw. Thus if desired the mounting screw 90 can be eliminated, and with it the need for the pair of countersunk bores 44, 46 in the face plate 10.

Figure 18:
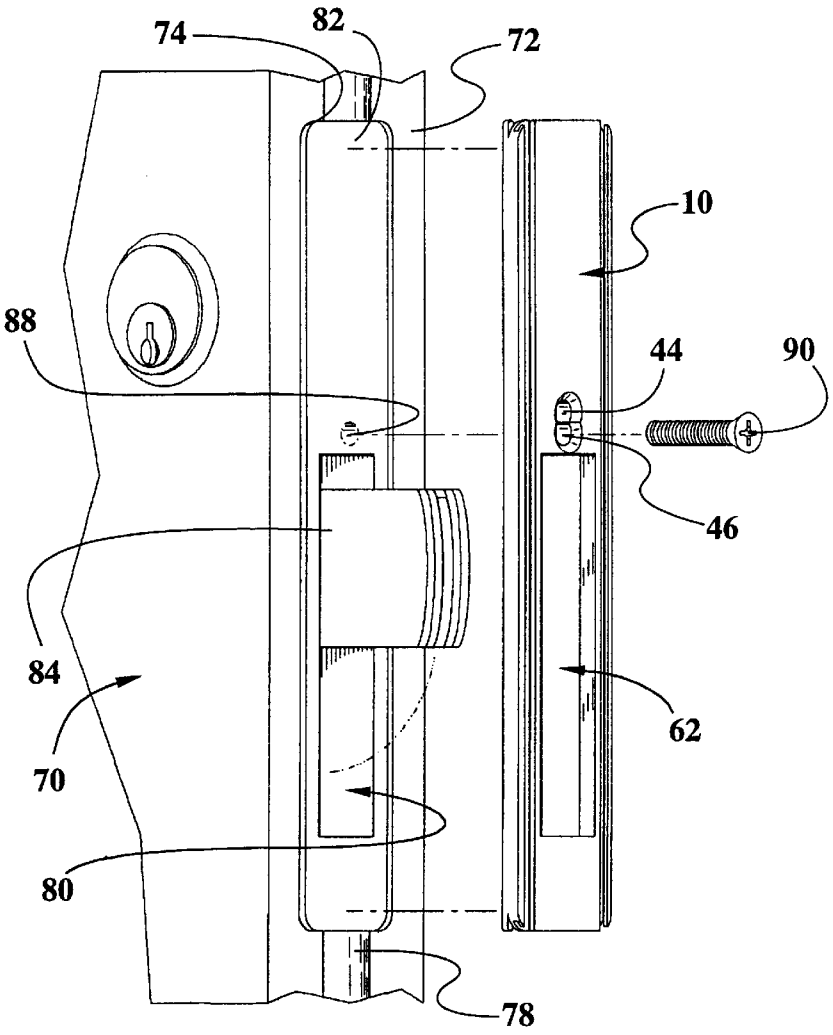
FIG. 18 is a perspective view showing the vertical edge of the lock stile of a door having a lock of a first configuration installed therein, with the face plate of FIG. 12 exploded away from the door edge.

FIGS. 18–21 illustrate how removing various combinations of knock-outs 36, 42 enables the face plate 10 to accommodate various configurations of latches and deadbolts. Referring to FIG. 18, mounted to the door stile 70 is a door lock mechanism 80 marketed by Adams Rite Manufacturing Co., of City of Industry, California., under the designation Deadlock Series MS1850A. The Deadlock Series MS1850A includes a housing 82 and a bolt 84 which pivots upwardly into engagement with a strike (not shown) on the door frame. To accommodate this pivoting action of the bolt 84, both knockouts 36, 42 are removed from the face plate 10 to provide a large central opening 62. The face plate 10 is positioned within the mortise 74 in the vertical edge 72 of the door stile 70, the central opening 62 clearing the bolt 84 of the door lock mechanism 80. A screw 90 is inserted through the inner bore 46 and threaded into a bore 88 in the housing 82 of the lock mechanism to secure the face plate 10 to the door 70.

Figure 19:
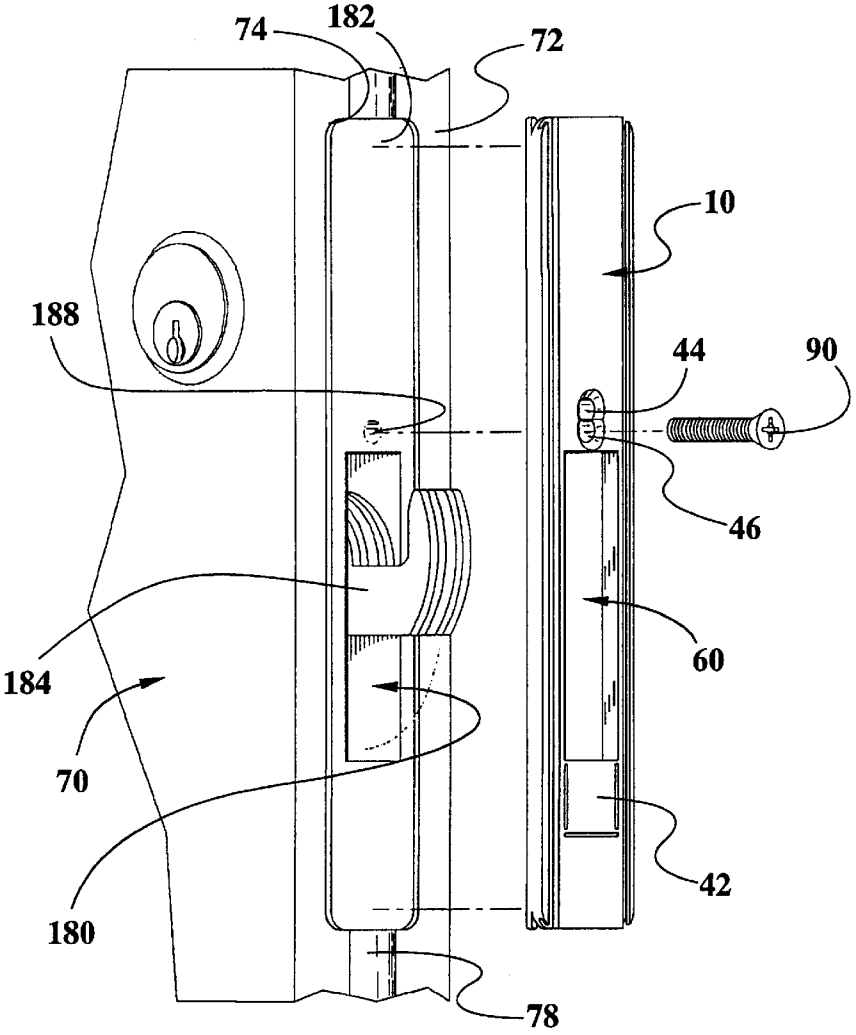
FIG. 19 is a perspective view showing the vertical edge of the lock stile of a door having a lock of a second configuration installed therein, with the face plate of FIG. 11 exploded away from the door edge.

FIG. 19 illustrates a door stile 70 to which is mounted an Adams Rite Deadlock Series MA1850A-050 lock mechanism 180. The Deadlock Series MA1850A-050 lock mechanism 180 comprises a housing 182 and a lock bolt 184 which is hook-shaped and swings up into engagement with a strike in the door frame (not shown) in an arcuate path. To accommodate the arcuate action of the lock bolt 184, the first knockout 36, but not the second knockout 42, is removed from the face plate 10 to create a central opening 60. The face plate 10 is positioned within the mortise 74 in the edge 72 of the door stile 70, the central opening 60 clearing the lock bolt 180 of the door lock. A screw 90 is inserted through the inner countersunk bore 46 and threaded into a hole 188 in the housing 182 of the lock mechanism 180 to secure the face plate 10 to the door stile 70.

Figure 20:
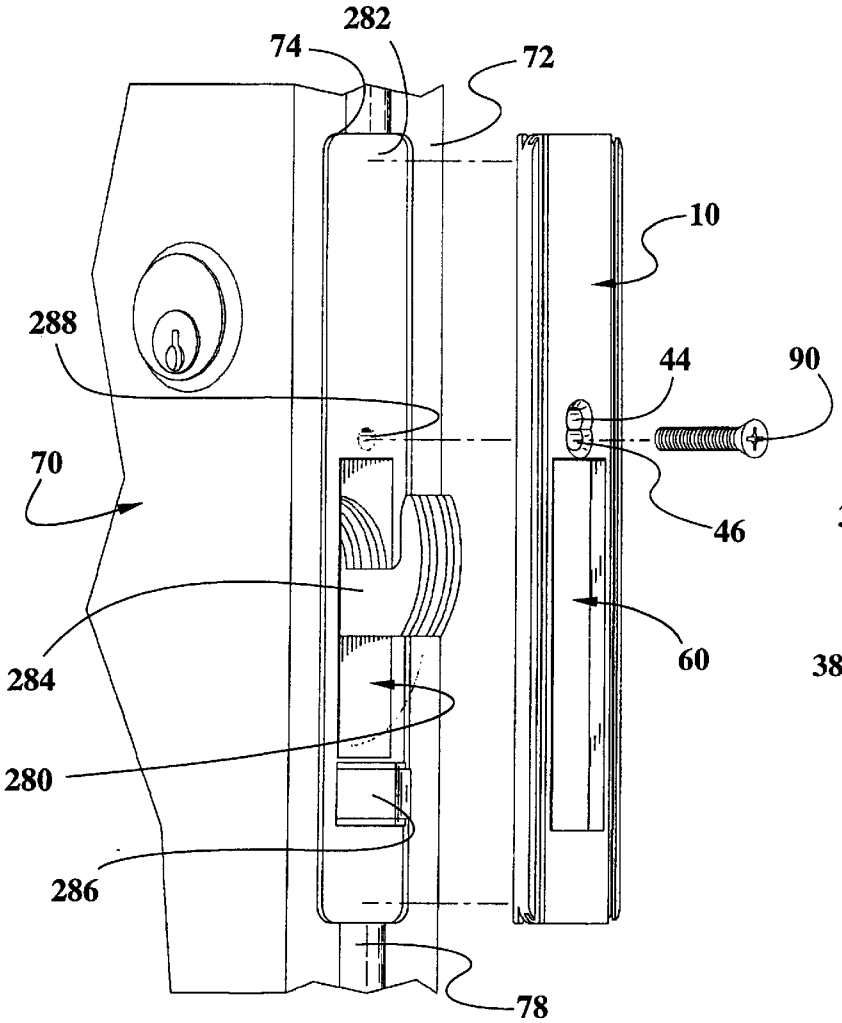
FIG. 20 is a perspective view showing the vertical edge of the lock stile of a door having a lock of a third configuration installed therein, with the face plate of FIG. 12 exploded away from the door edge.

Referring now to FIG. 20, mounted to the door 70 is an Adams Rite Latch/Lock Series MS+1890 lock mechanism 280. The lock comprises a housing 282, a lock bolt 284, and a latch bolt 286. As in the lock mechanisms 80, 180 previously described, the lock bolt 284 swings up into engagement with the strike in an arcuate path. To accommodate the latch bolt 286 and the arcuate action of the lock bolt 284, both knockouts 36, 42 are removed from the face plate 10 to create a large central opening 62. The face plate 10 is positioned within the mortise 74 in the edge 72 of the door 70, the central opening 62 clearing the lock bolt 284 and latch bolt 286 of the lock mechanism 280. A screw 90 is inserted through the inner bore 46 and threaded into a hole 288 in the housing 282 of the lock mechanism 280 to secure the face plate 10 to the door 70.

Figure 21:
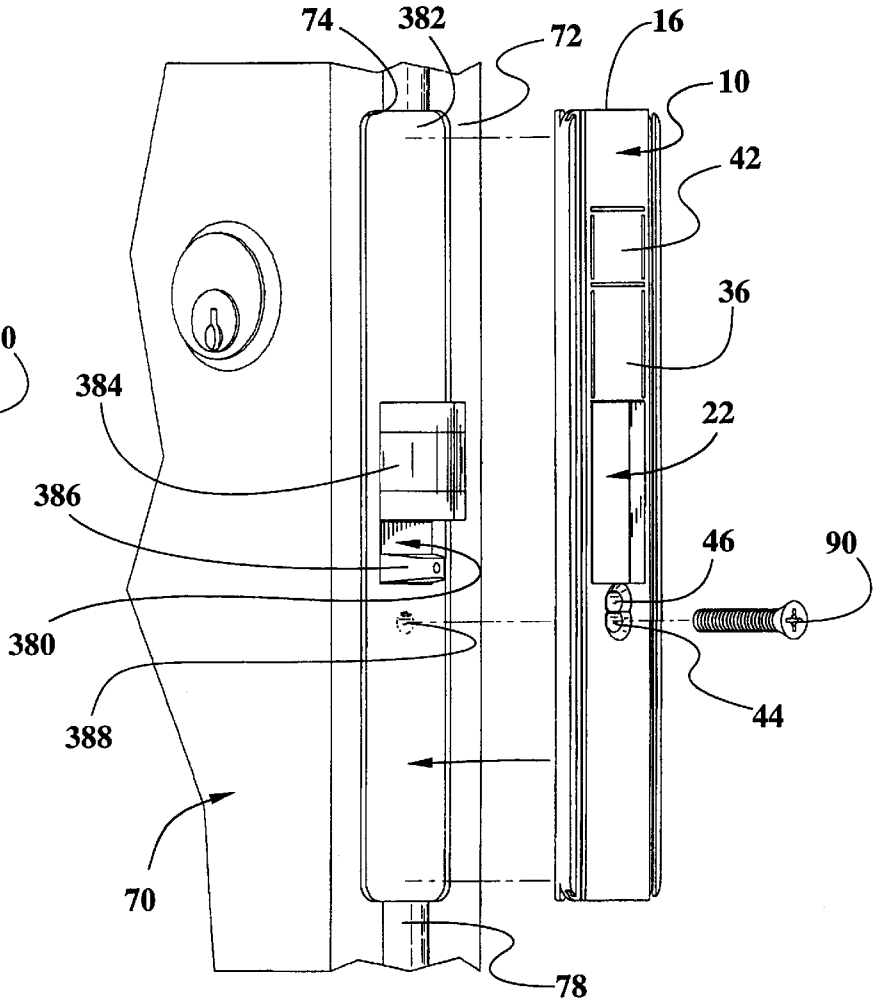
FIG. 21 is a perspective view showing the vertical edge of the lock stile of a door having a lock of a fourth configuration installed therein, with the face plate of FIG. 1 exploded away from the door edge.

With reference to FIG. 21, an Adams Rite Heavy Duty Deadlatch Series 4710 lock mechanism 380 is mounted within the door stile 70. The lock mechanism 380 includes a housing 382, a spring-loaded latch bolt 384, and an auxiliary bolt 386. The configuration of the latch bolt 384 and auxiliary bolt 386 is relatively compact, such that the face plate 10 can be installed over the lock without having to remove either of the knockouts 36, 42. The face plate 10 is positioned within the mortise 74 in the edge 72 of the door 70, the central opening 22 clearing the latch bolt 384 and auxiliary bolt 386 of the door lock. Because of the particular lock configuration, however, the face plate 10 is inverted from its normal orientation such that the edge previously identified as the lower edge 16 is located at the upper end of the face plate. To accommodate the inverted orientation of the face plate 10, the threaded hole 375 is mounted below the opening 378. To secure the face plate 10 to the door stile 70, a screw 90 is inserted through the outer bore 44 and threaded into a bore 388 in the housing 382 of the lock mechanism 380. It will be noted that, in contrast to the threaded bores 88, 188, and 288 of the previously disclosed embodiments, the threaded bore 388 is located beneath the bolts 384, 386.

In the disclosed embodiment the face plate 10 is molded from molded nylon or other suitable materials. If desired, the material from which the face plate 10 is molded may be provided in a color which will match the color of the door within which it is to be installed to eliminate the need for painting the face plate. Also in the disclosed embodiment, the exposed exterior surface of the face plate 10 is preferably provided with a non-glare or matte finish, such as by stippling or salinization.

Also in the disclosed embodiments, the separation lines 25–30 comprise core out slots, that is, a complete interruption through the face plate 10. However, it will be appreciated that other forms of separation lines can be provided, including scored lines which form lines of weakness along which the cover can be fractured or cut to separate the knockout panels from the cover.

While the foregoing embodiments have been described with respect to particular locks marketed by a specific company, it will be understood that these locks are identified for illustrative purposes only and that the invention is not limited to a face plate for use with any particular lock. The fundamental principle of this aspect of the invention is that the face plate 10 can be modified to accommodate a particular lock configuration, in contrast to the prior art approach of designing the face plate specifically for the particular lock configuration.

Finally, it will be understood that the preferred embodiment has been disclosed by way of example, and that other modifications may occur to those skilled in the art without departing from the scope and spirit of the appended claims.

What is claimed is:

1. An apparatus for use with a lock mechanism and a door for concealing an exposed edge of the lock mechanism when the lock mechanism is installed within an opening in a vertical edge of a stile of the door, comprising:

a face plate having a width, first and second longitudinal edges, and a central opening;

a plurality of separation lines formed in said face plate and defining at least one knockout portion having a width which is less than said width of said face plate, said knockout portion being removable at the option of a user to accommodate a particular configuration of lock mechanism;

said face plate further comprising a weathering channel for mounting a weathering strip to said face plate, said weathering channel being formed adjacent said first longitudinal edge of said face plate and extending between said first longitudinal edge and an adjacent separation line;

whereby said knockout portion can be removed from said face plate without interrupting said weathering channel.

2. The apparatus of claim 1, wherein said face plate further comprises a second weathering channel for mounting a weathering strip to said face plate, said second weathering channel formed adjacent said second longitudinal edge of said face plate and extending between said second longitudinal edge and an adjacent separation line;

whereby said knockout portion can be removed from said face plate without interrupting either of said weathering channels.

3. An apparatus comprising:

a door having a stile, said stile of said door having a vertical edge, and said vertical edge of said stile having an opening therein;

a lock mechanism mounted within said opening in said vertical edge of said stile of said door, said lock mechanism having an outer edge facing said opening in said vertical edge of said stile;

a face plate configured to fit within said opening in said vertical edge of said door stile, said face plate having upper and lower edges, and said face plate having a back face which confronts an adjacent portion of said lock mechanism when said face plate is installed within said opening;

an upper tab at said upper edge of said face plate; and a lower tab at said lower edge of said face plate, each of said upper and lower tabs being configured to hook behind said door stile when said face plate is installed within said opening so as to retain said face plate in place, and said face plate being retained in position by way of an interference fit between said lock mechanism and said door stile;

whereby said face plate conceals said outer edge of said lock mechanism.

4. The face plate of claim 3, wherein said face plate is generally rectangular, wherein said upper tab comprises a first upper tab, and wherein said lower tab comprises a first lower tab, said apparatus further comprising a second upper tab at said upper edge of said face plate and a second lower tab at said lower edge of said face plate such that a tab is disposed adjacent each corner of said generally rectangular face plate.

5. The face plate of claim 3, wherein said face plate comprises a front face, wherein each of said tabs comprises a forward edge, and wherein said forward edge of each of said tabs lies in a plane which is rearward of said front face of said face plate.

6. An apparatus comprising:

a door having a stile, said stile of said door having a vertical edge, and said vertical edge of said stile having an opening therein;

a lock mechanism mounted within said opening in said vertical edge of said stile of said door, said lock mechanism having an outer edge facing said opening in said vertical edge of said stile;

a face plate having a panel configured to fit within said opening in said vertical edge of said door stile and substantially coplanar with said vertical edge of said door stile, said panel having upper and lower edges, and said panel having a back face which confronts an adjacent portion of said lock mechanism when said face plate is installed within said opening; and an upper tab at said upper edge of said face plate; and a lower tab at said lower edge of said face plate, each of said upper and lower tabs being configured to hook behind said door stile when said face plate is installed within said opening so as to retain said face plate in place, said face plate being retained in place by an interference fit, constrained from being displaced outward by said tabs, constrained from being displaced inward by said adjacent portion of said lock mechanism, and constrained from being displaced vertically and laterally by said opening in the door.

7. The face plate of claim 6, wherein said panel comprises a front face, wherein each of said tabs comprises a forward edge, and wherein said forward edge of each of said tabs lies in a plane which is rearward of said front face of said panel of said face plate.

* * * * *